US007096183B2

(12) United States Patent
Junqua

(10) Patent No.: US 7,096,183 B2
(45) Date of Patent: Aug. 22, 2006

(54) CUSTOMIZING THE SPEAKING STYLE OF A SPEECH SYNTHESIZER BASED ON SEMANTIC ANALYSIS

(75) Inventor: Jean-Claude Junqua, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 731 days.

(21) Appl. No.: 10/083,839

(22) Filed: Feb. 27, 2002

(65) Prior Publication Data

US 2003/0163314 A1 Aug. 28, 2003

(51) Int. Cl.
*G10L 13/08* (2006.01)

(52) U.S. Cl. ..... 704/258; 704/260; 704/268

(58) Field of Classification Search ..... 704/260, 704/258, 268
See application file for complete search history.

(56) References Cited

U.S. PATENT DOCUMENTS

| | | | | |
|---|---|---|---|---|
| 5,636,325 | A * | 6/1997 | Farrett | 704/258 |
| 5,924,068 | A * | 7/1999 | Richard et al. | 704/260 |
| 6,253,169 | B1 * | 6/2001 | Apte et al. | 704/9 |
| 6,539,354 | B1 * | 3/2003 | Sutton et al. | 704/260 |
| 6,865,533 | B1 * | 3/2005 | Addison et al. | 704/260 |

* cited by examiner

*Primary Examiner*—V. Paul Harper
(74) *Attorney, Agent, or Firm*—Harness, Dickey & Pierce, PLC

(57) ABSTRACT

A method is provided for customizing the speaking style of a speech synthesizer. The method includes: receiving input text; determining semantic information for the input text; determining a speaking style for rendering the input text based on the semantic information; and customizing the audible speech output of the speech synthesizer based on the identified speaking style.

9 Claims, 3 Drawing Sheets

CUSTOMIZING THE SPEAKING STYLE OF A SPEECH SYNTHESIZER BASED ON SEMANTIC ANALYSIS

BACKGROUND OF THE INVENTION

The present invention relates generally to text-to-speech synthesis, and more particularly, to a method for customizing the speaking style of a speech synthesizer based on semantic analysis of the input text.

Text-to-speech synthesizer systems convert character-based text into synthesized audible speech. Text-to-speech synthesizer systems are used in a variety of commercial applications and consumer products, including telephone and voicemail prompting systems, vehicular navigation systems, automated radio broadcast systems, and the like.

Prosody refers to the rhythmic and intonational aspects of a spoken language. When a human speaker utters a phrase or sentence, the speaker will usually, and quite naturally, place accents on certain words or phrases, to emphasize what is meant by the utterance. In contrast, text-to-speech synthesizer systems can have great difficulty simulating the natural flow and inflection of the human-spoken phrase or sentence. Consequently, text-to-speech synthesizer systems incorporate prosodic analysis into the process of rendering synthesizer speech. Although prosodic analysis typically involves syntax assessments of the input text at a very granular level (e.g., at a word or sentence level), it does not involve a semantic assessment of the input text.

Therefore, it is desirable to provide a method for customizing the speaking style of a speech synthesizer based on semantic analysis of the input text.

SUMMARY OF THE INVENTION

In accordance with the present invention, a method is provided for customizing the speaking style of a speech synthesizer. The method includes: receiving input text; determining semantic information for the input text; determining a speaking style for rendering the input text based on the semantic information; and customizing the audible speech output of the speech synthesizer based on the selected speaking style.

For a more complete understanding of the invention, its objects and advantages, refer to the following specification and to the accompanying drawings.

DETAILED DESCRIPTION OF THE PREFERRED EMBODIMENTS

Figure 1:
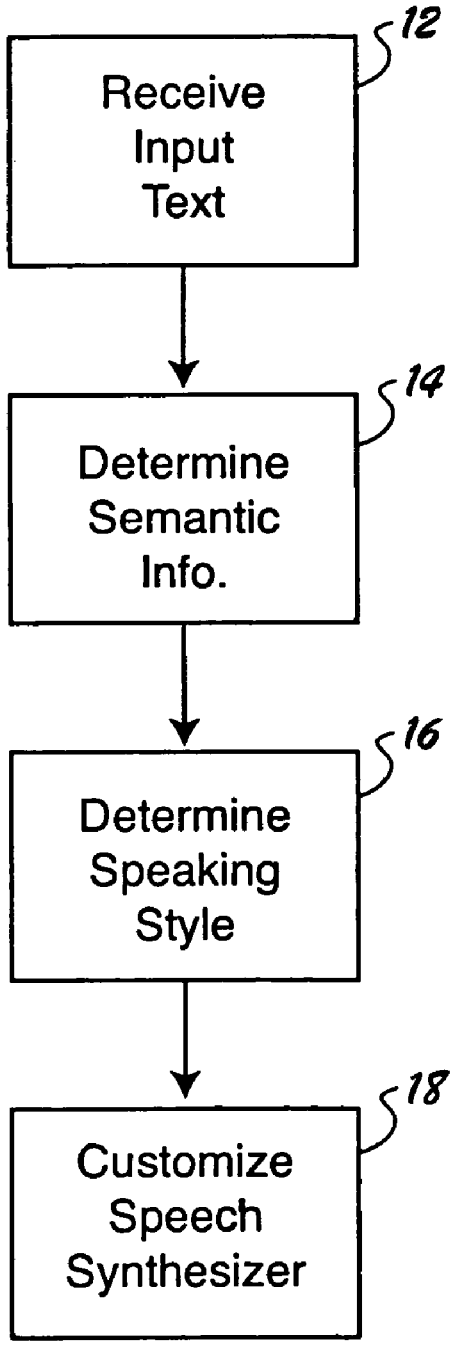
FIG. 1 is a flowchart illustrating a method for customizing the speaking style of a speech synthesizer based on long-term semantic analysis of the input text in accordance with the present invention.

FIG. 1 illustrates a method for customizing the speaking style of a speech synthesizer based on semantic analysis of the input text. While the following description is provided with reference to customizing the speaking style of the speech synthesizer, it is readily understood that the broader aspects of the present invention includes customizing other aspects of the text-to-speech synthesizer system. For instance, the expression of a talking head (e.g., a happy talking head) or the screen display of a multimedia user interface may also be altered based on the semantic analysis of the input text.

First, input text is received at step 12 into the text-to-speech synthesizer system. The input text is subsequently analyzed to determine semantic information at step 14. Semantic analysis of the input text is preferably in the form of topic detection. However, for purposes of the present invention, semantic analysis refers to various techniques that may be applied to input text having three or more sentences.

Topic detection may be accomplished using a variety of well known techniques. In one preferred technique, topic detection is based on the frequency of keyword occurrences in the text. The topic is selected from a list of anticipated topics, where each anticipated topic is characterized by a list of keywords. To do so, each keyword occurrence is counted. A topic for the input text is determined by the frequency of keyword occurrences and a measure of similarity between the computed keyword occurrences and the list of preselected topics. An alternative technique for topic detection is disclosed in U.S. Pat. No. 6,104,989 which is incorporated by reference herein. It is to be understood that other well known techniques for topic detection are also within the scope of the present invention.

A speaking style can impart an overall tone and better understanding of a communication. For instance, if the topic is news, then the speaking style of a news anchorperson may be used to render the input text. Alternatively, if the topic is sports, then the speaking style of a sportscaster may be used to render the input text. Thus, the selected topic is used at step 16 to determine a speaking style for rendering the input text. In a preferred embodiment, the speaking style is selected from a group of pre-determined speaking styles, where each speaking style is associated with one or more of the anticipated topics.

It is envisioned that semantic analysis may be performed on one or more subsets of the input text. For example, large blocks of input text may be further partitioned into one or more context spaces. Although each context space preferably includes at least three phrases or sentences, semantic analysis may also occur at a more granular level. Semantic analysis is then performed on each context space. In this example, a speaking style may be selected for each context space.

Lastly, the audible speech output of the speech synthesizer is customized at step 18 based on the selected speaking style. For instance, a news anchorperson typically employs a very deliberate speaking style that may be characterized by a slower speaking rate. In contrast, a sportscaster reporting the exciting conclusion of a sporting event may employ a faster speaking rate. Different speaking styles may be characterized by different prosodic attributes. As will be more fully described below, the prosodic attributes for a selected speaking style are then used to render audible speech.

Figure 2:
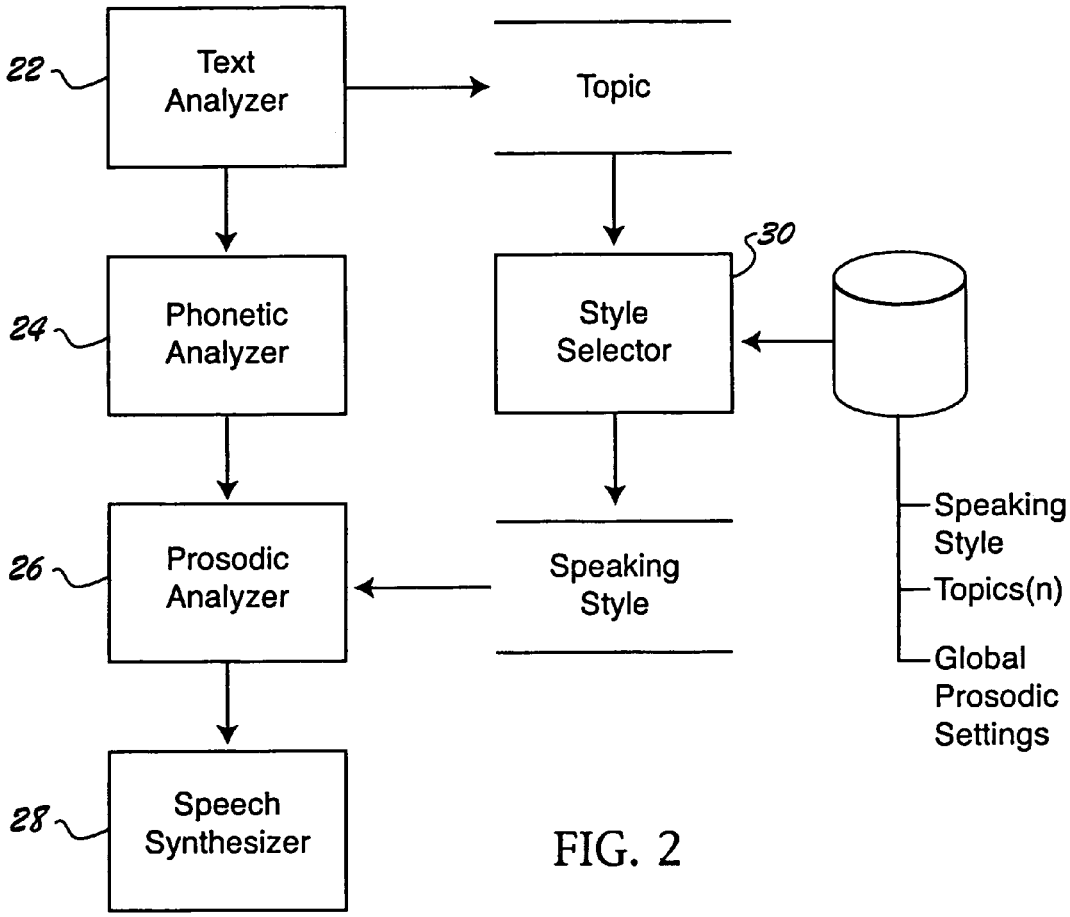
FIG. 2 is a block diagram depicting an exemplary text-to-speech synthesizer system in accordance with the present invention.

An exemplary text-to-speech synthesizer is shown in FIG. 2. The text-to-speech synthesizer 20 is comprised of a text analyzer 22, a phonetic analyzer 24, a prosodic analyzer 26 and a speech synthesizer 28. In accordance with the present invention, the text-to-speech synthesizer 20 further includes a speaking style selector 30.

In operation, the text analyzer 22 is receptive of target input text. The text analyzer 22 generally conditions the input text for subsequent speech synthesis. In a simplistic form, the text analyzer 22 performs text normalization which involves converting non-orthographic items in the text, such as numbers and symbols, into a text form suitable for subsequent phonetic conversion. A more sophisticated text analyzer 22 may perform document structure detection, linguistic analysis, and other known conditioning operation.

The phonetic analyzer 24 is then adapted to receive the input text from the text analyzer 22. The phonetic analyzer 24 converts the input text into corresponding phoneme transcription data. It is to be understood that various well known phonetic techniques for converting the input text are within the scope of the present invention.

Next, the prosodic analyzer 26 is adapted to receive the phoneme transcription data from the phonetic analyzer 24. The prosodic analyzer 26 provides a prosodic representation of the phoneme data. Similarly, it is to be understood that various well known prosodic techniques are within the scope of the present invention.

Lastly, the speech synthesizer 28 is adapted to receive the prosodic representation of the phoneme data from the prosodic analyzer 26. The speech synthesizer renders audible speech using the prosodic representation of the phoneme data.

To customize the speaking style of the speech synthesizer 28, the text analyzer 22 is further operable to determine semantic information for the input text. In one preferred embodiment, a topic for the input text is selected from a list of anticipated topics as described above. Although determining the topic of the input text is presently preferred, it is envisioned that other types of semantic information may be determined for the input text. For instance, it may be determined that the input text embodies dialogue between two or more persons. In this instance, different voices may be used to render the text associated with different speakers.

A speaking style selector 30 is adapted to receive the semantic information from the text analyzer 22. The speaking style selector 30 in turn determines a speaking style for rendering the input text based on the semantic information. In order to render the input text in accordance with a particular speaking style, each speaking style is characterized by one or more global prosodic settings (also referred to herein as "attributes"). For instance, a happy speaking style correlates to an increase in pitch and pitch range with an increase in speech rate. Conversely, a sad speaking style correlates to a lower than normal pitch realized in a narrow range and delivered at a slow rate and tempo. Each prosodic setting may be expressed as a rule which is associated with one or more applicable speaking styles. One skilled in the art will readily recognize other types of global prosodic settings may also be used to characterize a speaking style. The selected speaking style and associated global prosodic settings are then passed along to the prosodic analyzer 26.

Figure 3:
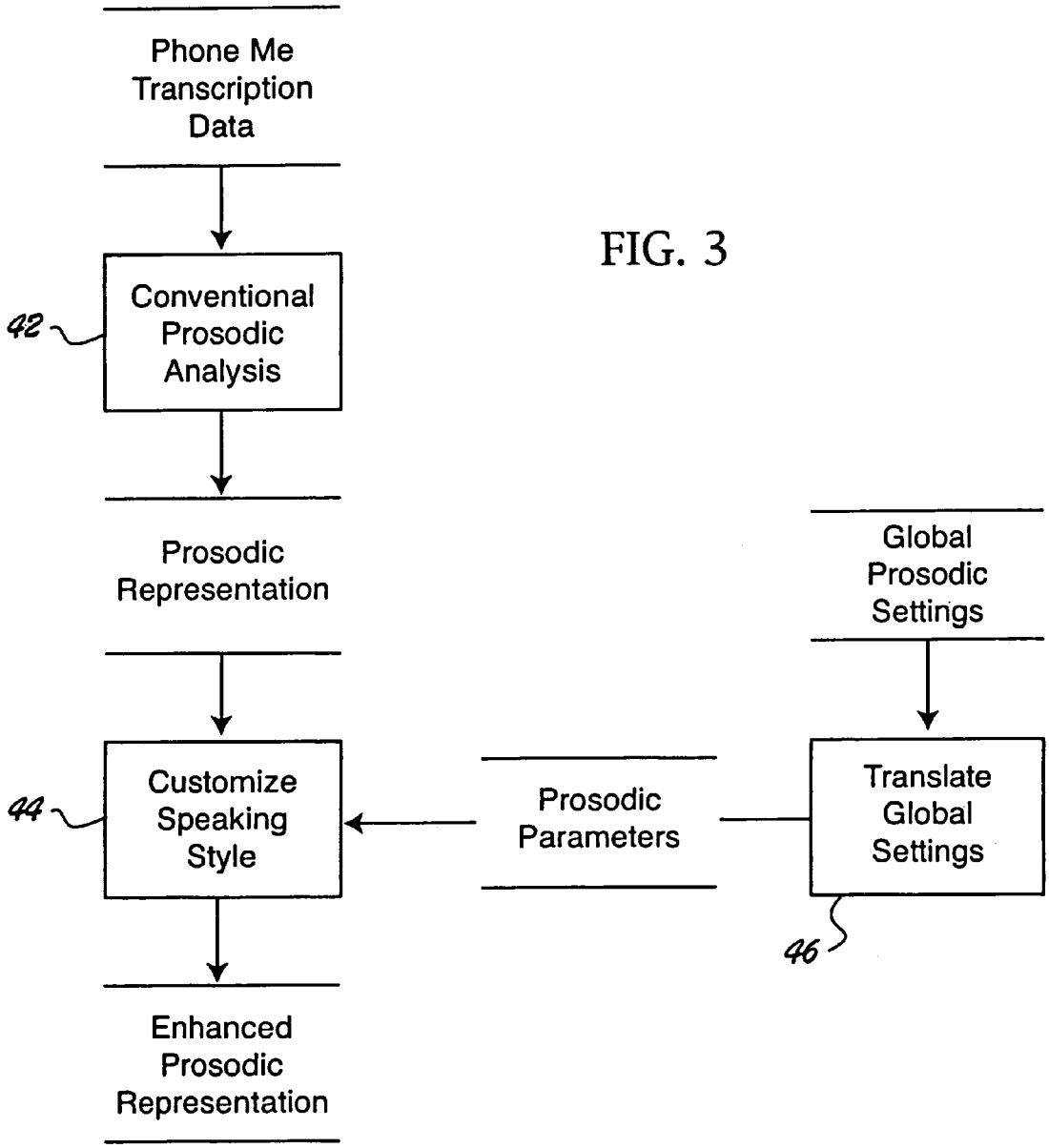
FIG. 3 is block diagram depicting how global prosodic settings are applied to phoneme data by an exemplary prosodic analyzer in accordance with the present invention.

Global prosodic settings are then applied to phoneme data by the prosodic analyzer 26 as shown in FIG. 3. In a preferred embodiment, the global prosodic settings are specifically translated into particular values for one or more of the local prosodic parameters, such as pitch, pauses, duration and volume. The local prosodic parameters are in turn used to construct and/or modify an enhanced prosodic representation of the phoneme transcriptions data which is input to the speech synthesizer. For instance, an exemplary global prosodic setting may be an increased speaking rate. In this instance, the increased speaking rate may translate into a 2 ms reduction in duration for each phoneme that is rendered by the speech synthesizer. The speech synthesizer then renders audible speech using the prosodic representation of the phoneme data as is well known in the art. An exemplary speech synthesizer is disclosed in U.S. Pat. No. 6,144,939 which is incorporated by reference herein.

The foregoing discloses and describes merely exemplary embodiments of the present invention. One skilled in the art will readily recognize from such discussion, and from accompanying drawings and claims, that various changes, modifications, and variations can be made therein without departing from the spirit and scope of the present invention.

The invention claimed is:

1. A method for generating synthesized speech, comprising:

receiving a block of input text into a text-to-speech synthesizing system;

partitioning the block of input text into a plurality of context spaces each containing multiple phrases;

performing semantic analysis on each context space in order to identify a topic for each context space;

selecting a speaking style for each context space from a plurality of predefined speaking styles based on the topics identified respective of the context spaces, where each speaking style correlates to prosodic parameters and is associated with one or more anticipated topics;

converting the sentences to corresponding phoneme data;

applying prosodic parameters which correlate to the selected speaking style to the phoneme data, thereby generating a prosodic representation of the phoneme data; and generating audible speech using the prosodic representation of the phoneme data.

2. The method of claim 1 wherein the step of determining a topic for the input text further comprises:

defining a plurality of anticipated topics, such that each anticipated topic is associated with keywords that are indicative of the topic;

determining frequency of the keywords in the input text; and selecting a topic for the input text from the plurality of anticipated topics based on the frequency of keyword occurrences contained therein.

3. A method for customizing the speaking style of a text-to-speech synthesizer system, comprising:

receiving a block of input text which;

partitioning the block of input text into a plurality of context spaces each containing multiple phrases;

determining semantic information for each context space selecting a speaking style for each context space from a plurality of predefined speaking styles based on the semantic information, where each speaking style correlates to prosodic parameters and is associated with one or more anticipated topics; and customizing an output parameter of a multimedia user interface of the text-to-speech synthesizer system based on the speaking style, where the text-to-speech synthesizer system is operable to render audible speech which correlates to the input text.

4. The method of claim 3 wherein the step of determining semantic information further comprises determining a topic for the input text.

5. The method of claim 3 wherein the step of determining semantic information further comprises partitioning the input text into a plurality of context spaces, and determining a topic for each of the plurality of context spaces.

6. The method of claim 1 wherein the step of customizing an output parameter further comprises generating synthesized speech.

7. The method of claim 1 wherein the step of customizing an output parameter further comprises correlating the selected speaking style to one or more prosodic parameters and rendering audible speech for the input text using the prosodic parameters.

8. The method of claim 1 wherein the step of customizing an output parameter further comprises modifying at least one of an expression of a visually displayed talking head and another attribute of a visual display.

9. A text-to-speech synthesizer system, comprising:

a text analyzer receptive of a block of input text and operable to partition the block of input text into a plurality of context spaces each containing multiple phrases and determine semantic information for each context space;

a style selector adapted to receive semantic information from the text analyzer and operable to determine, for each context space, a speaking style for rendering the input text contained in that context space based on the semantic information, where the selected speaking style correlates to one or more prosodic attributes;

a phonetic analyzer adapted to receive input text from the text analyzer and operable to convert the input text into corresponding phoneme data;

a prosodic analyzer adapted to receive phoneme data from the phonetic analyzer and the prosodic attributes from the style selector, the prosodic analyzer further operable to apply the prosodic attributes to the phoneme data to form a prosodic representation of the phoneme data; and a speech synthesizer adapted to receive the prosodic representation of the phoneme data from the prosodic analyzer and operable to generate audible speech.

* * * * *